US011772955B1

(12) United States Patent
Witt, Jr.

(10) Patent No.: US 11,772,955 B1
(45) Date of Patent: Oct. 3, 2023

(54) SYSTEM, AND APPARATUS FOR PROTECTING FUEL DISPENSERS

(71) Applicant: Leonard Witt, Jr., Winter Park, FL (US)

(72) Inventor: Leonard Witt, Jr., Winter Park, FL (US)

( * ) Notice: Subject to any disclaimer, the term of this patent is extended or adjusted under 35 U.S.C. 154(b) by 0 days.

(21) Appl. No.: 17/723,499

(22) Filed: Apr. 19, 2022

(51) Int. Cl.
*B67D 7/34* (2010.01)
*B67D 7/62* (2010.01)
*B67D 7/32* (2010.01)

(52) U.S. Cl.
CPC ..... *B67D 7/3272* (2013.01); *B67D 7/34* (2013.01); *B67D 7/62* (2013.01)

(58) Field of Classification Search
CPC ..... B67D 7/3272; B67D 7/34
See application file for complete search history.

(56) References Cited

U.S. PATENT DOCUMENTS 3,858,758 A * 1/1975 May ..... B67D 7/08 705/413
9,107,973 B1 * 8/2015 Robinson ..... A61L 2/10
2009/0044866 A1 * 2/2009 Pearson ..... F02M 37/18 137/87.01
2013/0223875 A1 * 8/2013 Bin ..... H01H 9/20 200/50.01
2015/0211684 A1 * 7/2015 Santos ..... F17C 11/007 137/1

* cited by examiner

*Primary Examiner* — Paul J Gray
(74) *Attorney, Agent, or Firm* — Larson & Larson; Frank Liebenow; Justin P. Miller

(57) ABSTRACT

A security device for a fuel dispenser includes a stepping relay having contacts arranged in series between a source of power and a fuel pump such that when the contacts are open, no fuel can be dispensed. The stepping relay is triggered by one or more door interlock switches that are powered by the fuel pump side of the contacts such that, when an access door is opened, the relay is triggered and the door interlock switches are no longer powered, hence, disabled. Therefore, a reset switch that is constantly powered is interfaced to trigger the stepping relay to close the contacts and allow fuel to be dispensed. Preferably, the reset switch is either remotely located or has a security feature.

13 Claims, 6 Drawing Sheets

SYSTEM, AND APPARATUS FOR PROTECTING FUEL DISPENSERS

FIELD

This invention relates to the field of dispensers and more particularly an interlock device for reducing theft of fuel.

BACKGROUND

As gas prices surge, so does attempts as stealing fuel (e.g., gasoline, diesel). There are many ways people can steal fuel. People steal fuel from private individuals by pumping or siphoning fuel from a parked car or boat.

Stealing from service stations is on the rise. One way to steal fuel from a service station is to position a vehicle that has a hole in floor over the tank, prying off the tank cover, and pumping the fuel directly from the underground tank of the service station into a tank in the vehicle.

Another way to steal fuel from a service station is to pump the fuel without paying. As most modern fuel dispensers require pre-payment or use of a credit card before fuel is dispensed, the thieves often find ways to bypass the authorization system to enable the fuel pump within the dispenser without presenting a valid credit card. In this mode of theft, the thief opens the access door of the fuel dispenser and electrically bypasses the credit card authorization system to start the fuel pump without paying. Often the access door of the fuel dispenser is locked, but a thief will jimmy the lock or pry open the access door to steal whatever fuel they can put into their vehicle and, possible, several portable fuel canisters.

What is needed is a system that will detect any access to the access door of the fuel dispenser and disable the fuel pump until an employee of the service station resets the system.

SUMMARY

A security device for a fuel dispenser has a stepping relay with contacts arranged in series between a source of power and a fuel pump such that when the contacts are open, no fuel can be dispensed. The stepping relay is triggered by one or more door interlock switches that are powered by the fuel pump side of the contacts such that, when an access door is opened, the relay is triggered and the door interlock switches are no longer powered, hence, disabled. Therefore, a reset switch that is constantly powered is interfaced to trigger the stepping relay to close the contacts and allow fuel to be dispensed. Preferably, the reset switch is either remotely located or has a security feature.

In one embodiment, a security device for a fuel dispenser is disclosed including a stepping relay that has a coil input and contacts that alternately open and close after each electrical pulse received at the coil input. The contacts are arranged in series between a source of power and an input power to a fuel pump system such that when the contacts are open, power does not flow to the fuel pump system and no fuel can be dispensed. There is at least one door interlock switch that is mechanically interfaced to an access door of the fuel dispenser and interfaced to the input power of the fuel pump system such that when the contacts of the stepping relay are closed, opening of the access door causes at least one of the door interlock switches to close, providing power to the coil input, thereby the contacts of the stepping relay open to disconnect the power from the input power to the fuel pump system. As no power is then provided to the door interlock switches, further operation of the door interlock switches do not energize the coil input of the stepping relay. Therefore, a reset switch is interfaced between the source of the power and the coil input such that operation of the reset switch provides the power to the coil input, thereby causing the stepping relay to step such that if the contacts are open, the contacts close; and if the contacts are closed, the contacts open. It is preferred that the reset switch be a locking momentary contact switch or remotely located away from the fuel dispenser.

In another embodiment, a method of reducing fuel theft from a fuel dispenser configured to pump fuel upon operation of a handle/spout of the fuel dispenser is disclosed including inserting contacts of a stepping relay between a power source and a fuel pump system and installing one or more door interlock switches mechanically interfaced to an access door of the fuel dispenser. The door interlock switches are electrically interfaced to a fuel pump side of the contacts of the stepping relay such that when the contacts of the stepping relay are closed and the access door is opened, at least one of the door interlock switches closes, powering a coil input of the stepping relay, resulting in the stepping relay contacts opening, thereby disconnecting the power from the input power to the fuel pump system. Once disconnected, the door interlock switches are not powered so cannot provide another pulse to the coil input, so a reset switch is electrically interfaced between the power source and the coil input such that closing of the reset switch provides power to the coil input, thereby causing the stepping relay to step such that if the contacts are open, the contacts close and if the contacts are closed, the contacts open.

In another embodiment, a security device for a fuel dispenser is disclosed including a stepping relay having a coil input, a first set of contacts and a second set of contacts. Both the first set of contacts and the second set of contacts alternately open and close after each electrical pulse is received at the coil input. The first set of contacts are electrically connected in series between a source of electric power and a power input of a fuel pump system such that when the first set of the contacts are open, electricity does not flow to the fuel pump system and no fuel can be dispensed. An uninterruptable power supply within the fuel dispenser receives electrical power from the source of the electric power and provides a low-voltage electrical power. At least one door interlock switch is mechanically interfaced to an access door of the fuel dispenser and is electrically interfaced to the low-voltage electric power through the second set of contacts such that when the second set of contacts are closed, opening of the access door causes at least one of the door interlock switches to close, providing the low-voltage electric power to the coil input which opens both the first set of contacts and the second set of contacts, thereby disconnecting the source of the electrical power from the fuel pump system. A reset switch (e.g., key-operated switch) is electrically interfaced between the low-voltage source of the power and the coil input such that operation of the reset switch connects the low-voltage source of the power to the coil input, thereby causing the stepping relay to step such that if the first set of contacts are open, the first set of contacts close; and if the first set of contacts are closed, the first set of contacts open.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
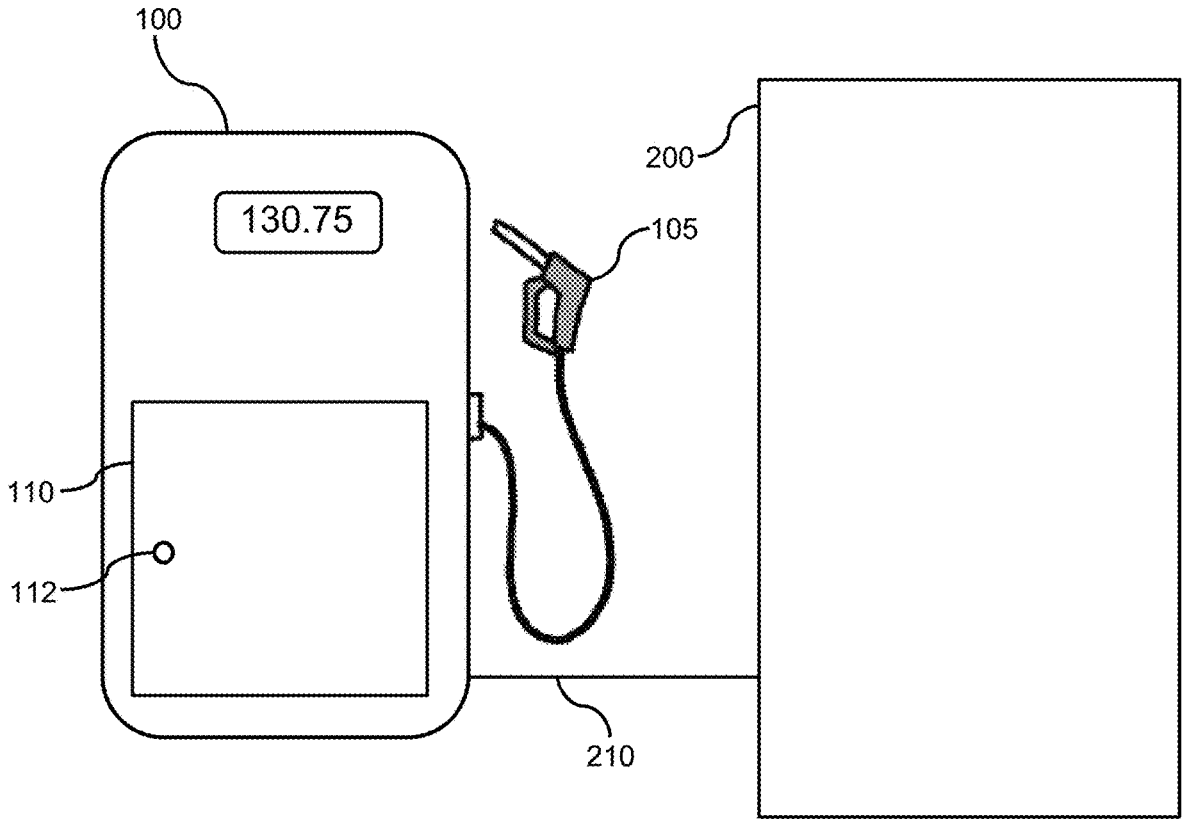
FIG. 1 (Prior Art)
FIG. 1 illustrates a schematic view of a fuel dispenser and central closet of the prior art.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a schematic view of a fuel dispenser 100 and central closet 200 of the prior art is shown. There are many existing fuel dispensers 100, each having a handle/spout 105 that transfers fuel from the fuel dispenser 100 into a filler of a vehicle (e.g., car, bus, truck, boat). Many existing fuel dispensers 100 have access doors 110 for gaining access to internal components and many such access doors 110 have locks 112 to help prevent tampering, though tampering is still common as evident by fuel theft and "skimming" cases reported daily in the news ("skimming" involves installing an electronic device into the fuel dispenser 100 that "skims" a customer's credit card for illegal use).

The central closet 200 provides power and signaling to one or more fuel dispensers 100 through a cable 210. Although shown as a central closet 200, any form/type of room, portion of a room, or stand-alone building is anticipated, providing the same or similar functionality.

Figure 2:
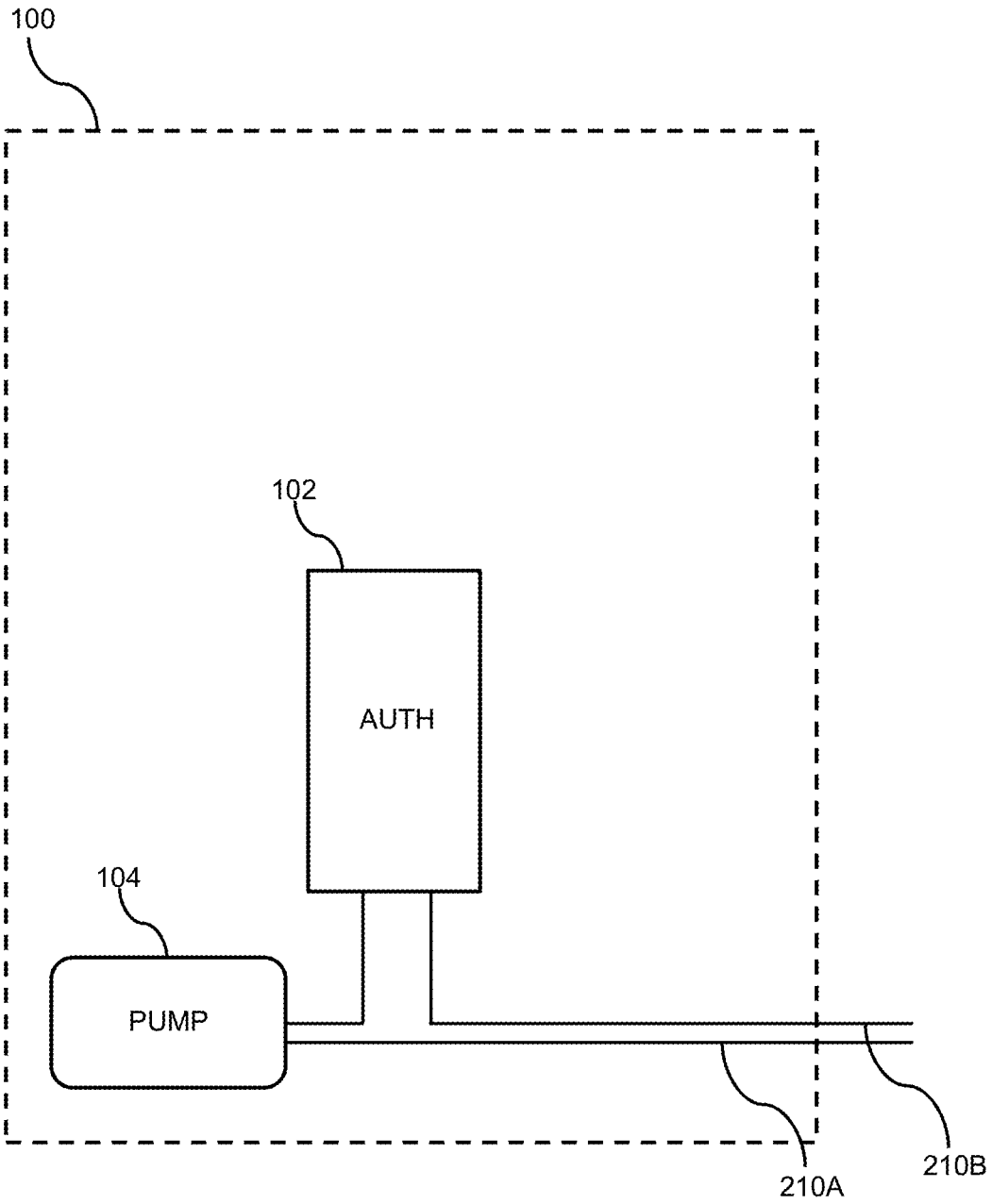
FIG. 2 (Prior Art)
FIG. 2 illustrates a simplified electrical schematic of a fuel dispenser of the prior art.

Referring to FIG. 2, a simplified electrical schematic of a fuel dispenser 100 of the prior art is shown. In this view of an existing fuel dispenser 100, the cable 210 is simplified and includes two conductors of AC power. One conductor (e.g., neutral) is connected directly to the fuel pump 104 and the other conductor is connected to the authorization subsystem 102 (e.g., payment acceptance by credit/debit card). Once the authorization subsystem 102 establishes that payment has been made, power (e.g., hot) is connected to the fuel pump 104 and the fuel pump 104 runs to deliver the fuel to the handle/spout 105. Note that there are many other components of the fuel dispenser 100 including metering to determine how much fuel has been pumped by the fuel pump 104, local display, remote display communication, authorization communication, emergency shutoff, etc., all of which are not shown for brevity and clarity reasons.

Figure 3:
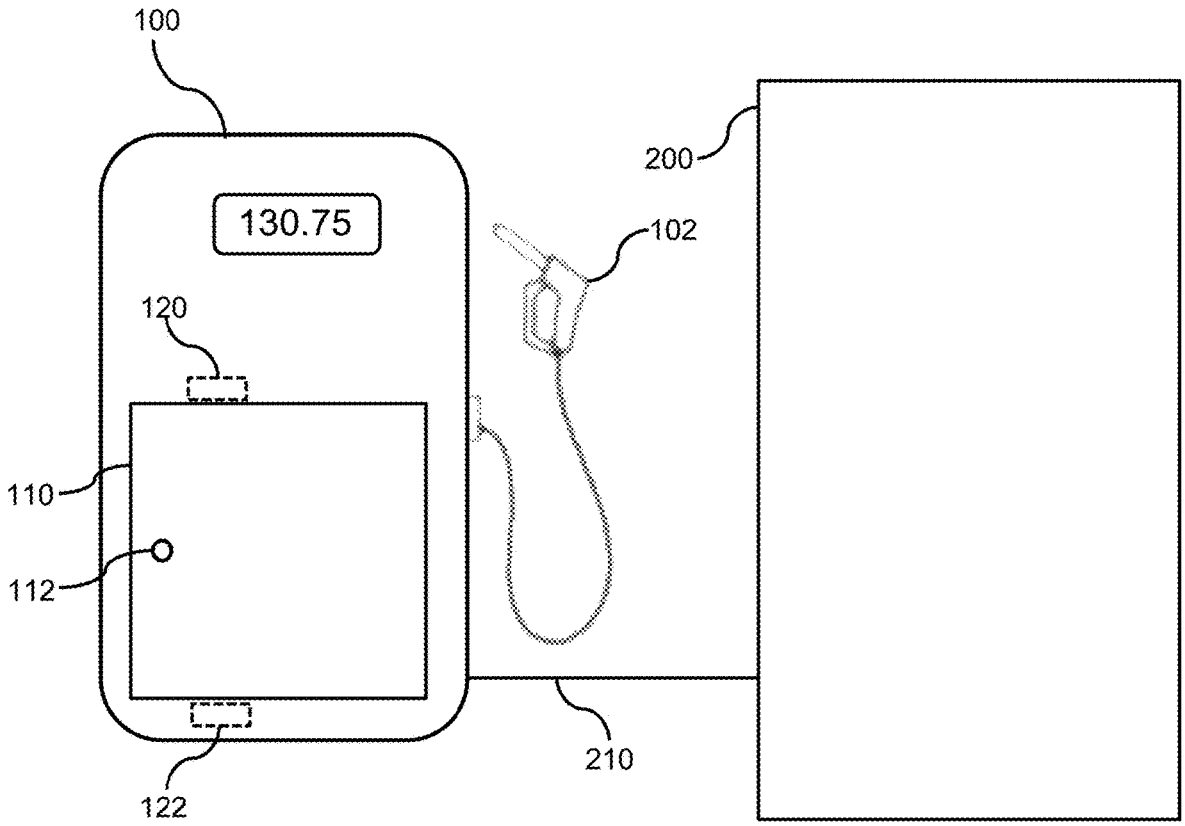
FIG. 3 illustrates a schematic view of a fuel dispenser and central closet equipped with access detection and fuel pump lock-out.

Referring to FIG. 3, a schematic view of a fuel dispenser 100 and central closet 200 equipped with access detection and fuel pump lock-out is shown. In this, door interlock switches 120/122 are mounted internal to the fuel dispenser and are operatively interfaced to the access door 110 such that, upon opening of the access door 110, the switches operate. Although the door interlock switches 120/122 are anticipated to be either normally open or normally closed, in the disclosed exemplary circuits, the door interlock switches 120/122 are normally open (e.g., the door interlock switches 120/122 close the circuit when the access door 110 is opened).

Figure 4:
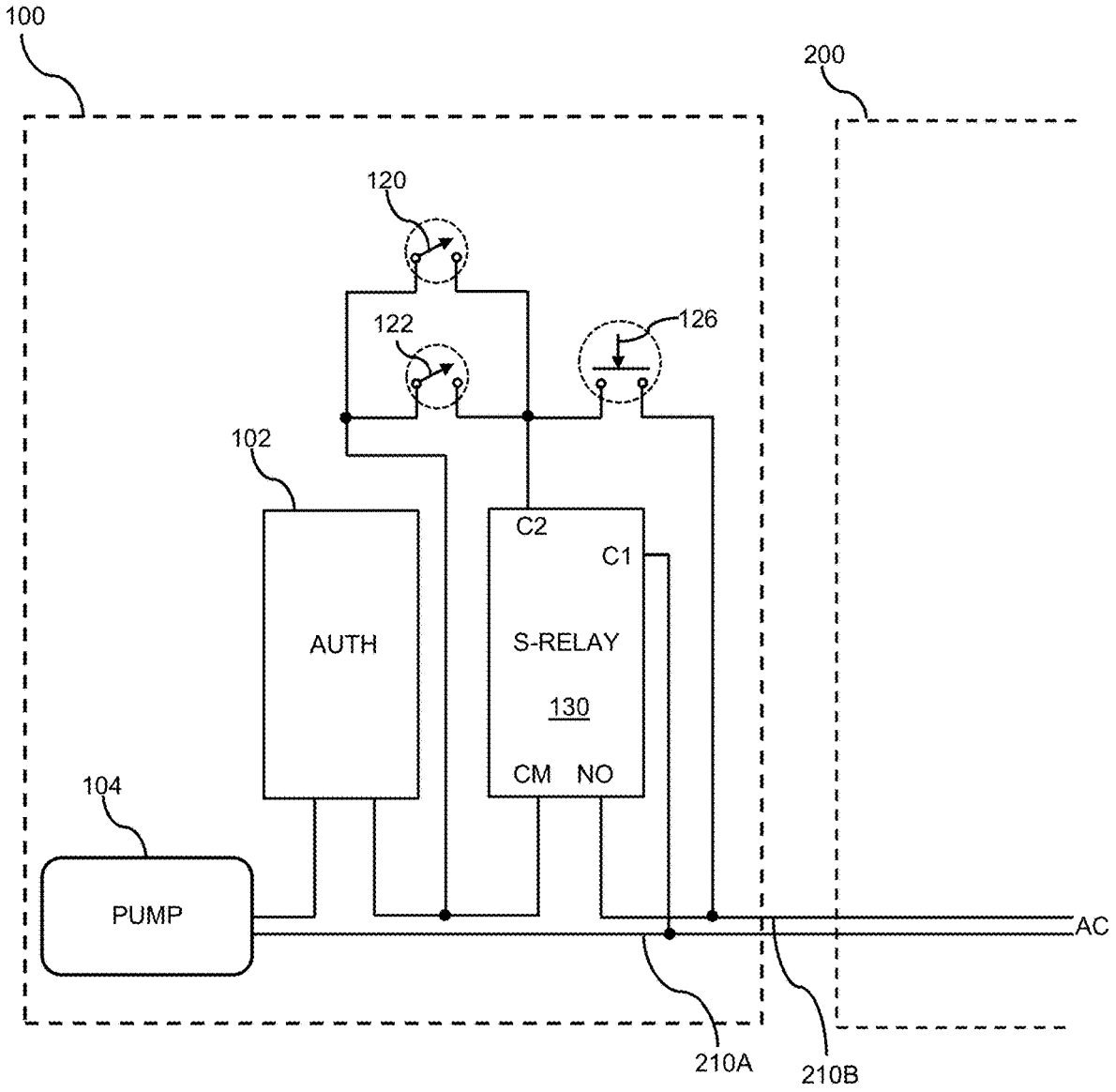
FIG. 4 illustrates an electrical schematic view of a fuel dispenser and central closet equipped with access detection and fuel pump lock-out.

Referring to FIG. 4, an electrical schematic view of a fuel dispenser 100 and central closet 200 equipped with access detection and fuel pump lock-out is shown. In this, AC power is provided by the central closet 200 through conductors 210A/210B, for example, a first conductor 210A is the neutral power and a second conductor 210B is the hot power, though any power and polarity are anticipated. The first conductor 210A is connected directly to the fuel pump 104 and to the C1 connection of a stepping relay 130. The stepping relay has connections for two coil inputs (C1 and C2) and connections for two contacts, a common (CM) and a normally open (NO), though a normally closed contact would work as well. Each voltage pulse between the two coil inputs (C1 and C2) "steps" the stepping relay 130 between open and closed. In one step of the stepping relay 130, the contacts (CM, NO) are open and in the alternate step of the stepping relay 130, the contacts (CM, NO) are closed. When the contacts (CM, NO) of the stepping relay 130 are closed, power from the second conductor 210B (e.g., Hot) is provided to the authorization subsystem 102 such that, if authorization is made, power is provided to the fuel pump 104 as well, resulting in dispensing of fuel from the handle/spout 105.

There are two sets of switches interfaced to the second coil input (C2) of the stepping relay 130. The first set of switches are the door interlock switches 120/122 that are normally open and wired in an "or" configuration such that if either of the door interlock switches 120/122 close, the circuit between the second coil input (C2) of the stepping relay 130 and the voltage potential from the output (CM) of the stepping relay 130 closes and, hence, when the stepping relay 130 is in the alternate step, the contacts (CM, NO) are closed and power is provided to one side of the door interlock switches 120/122. Now, if the access door 110 is now opened, the door interlock switches 120/122 close and the circuit between the second coil input (C2) of the stepping relay 130 and the voltage potential from the output (CM) of the stepping relay 130 receives power and the stepping relay 130 steps into the open step, in which the circuit between the stepping relay 130 contacts (CM, NO) open, thereby removing power from the authorization subsystem 102 and, subsequently, removing power from the fuel pump 104 so that no fuel can be pumped. Power is also removed from the door interlock switches 120/122 and, therefore, further operation of the door interlock switches 120/122 will not provide power pulses to the coil inputs (C1 and C2) of the stepping relay 130 and, the stepping relay 130 will remain in the open step.

To reset the stepping relay 130, a reset switch 126 is provided. Operating the reset switch 126 closes the circuit between the second coil input (C2) of the stepping relay 130 and the voltage potential from second conductor 210B (hot power) and the stepping relay 130 steps from the open step into the closed step.

Note that for added security, the reset switch 126 is anticipated to be a momentary key switch or other type of security switch. Note also that, even though the door interlock switches 120/122 are shown, any number of door interlock switches 120/122 are anticipated, including one door interlock switch 120/122. Two door interlock switches 120/122 are provided to prevent an intruder from defeating the lock 112 and bending the access door 110 without triggering the door interlock switches 120/122.

Figure 5:
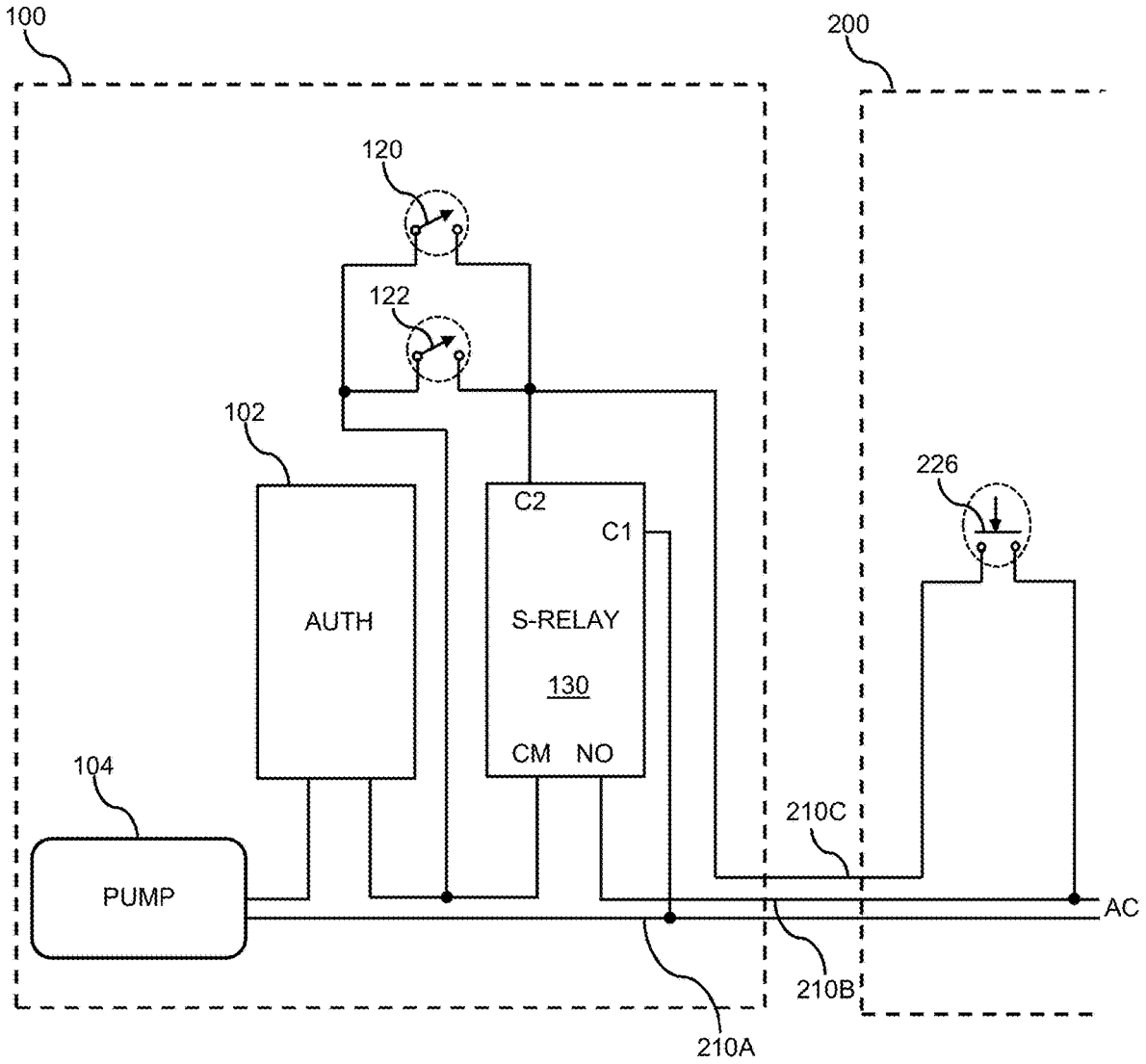
FIG. 5 illustrates a second electrical schematic view of a fuel dispenser and central closet equipped with access detection and fuel pump lock-out.

Referring to FIG. 5, a second electrical schematic view of a fuel dispenser 100 and central closet 200 equipped with access detection and fuel pump lock-out is shown. As in FIG. 4, AC power is provided by the central closet 200 through conductors 210A/210B, for example, a first conductor 210A is the neutral power and a second conductor 210B is the hot power. The first conductor 210A is connected directly to the fuel pump 104 and to the C1 connection of a stepping relay 130. The stepping relay has connections for two coil inputs (C1 and C2) and connections for two contacts, a common (CM) and a normally open (NO), though a normally closed contact would work as well. Each voltage pulse between the two coil inputs (C1 and C2) "steps" the stepping relay 130 between open and closed. In one step of the stepping relay 130, the contacts (CM, NO) are open and in the alternate step of the stepping relay 130, the contacts (CM, NO) are closed. When the contacts (CM, NO) of the stepping relay 130 are closed, power from the second conductor 210B (e.g., Hot) is provided to the authorization subsystem 102 such that, if authorization is made, power is provided to the fuel pump 104 as well, resulting in dispensing of fuel from the handle/spout 105.

There are two sets of switches interfaced to the second coil input (C2) of the stepping relay 130. The first set of switches are the door interlock switches 120/122 that are normally open and wired in an "or" configuration such that if either of the door interlock switches 120/122 close, the circuit between the second coil input (C2) of the stepping relay 130 and the voltage potential from the output (CM) of the stepping relay 130 closes and, hence, when the stepping relay 130 is in the alternate step, the contacts (CM, NO) are closed and power is provided to one side of the door interlock switches 120/122. Now, if the access door 110 is now opened, the door interlock switches 120/122 close and the circuit between the second coil input (C2) of the stepping relay 130 and the voltage potential from the output (CM) of the stepping relay 130 receives power and the stepping relay 130 steps into the open step, in which the circuit between the stepping relay 130 contacts (CM, NO) open, thereby removing power from the authorization subsystem 102 and, subsequently, removing power from the fuel pump 104 so that no fuel can be pumped. Power is also removed from the door interlock switches 120/122 and, therefore, further operation of the door interlock switches 120/122 will not provide power pulses to the coil inputs (C1 and C2) of the stepping relay 130 and, the stepping relay 130 will remain in the open step.

To reset the stepping relay 130, a remote reset switch 226 is provided. The remote reset switch 226 is housed remotely from the fuel dispenser 100, for example, in the central closed 200 and connected to the circuit within the fuel dispenser 100 by a spare wire 210C between the central closet 200 and the fuel dispenser 100. Operating the remote reset switch 226 closes the circuit between the second coil input (C2) of the stepping relay 130 and the voltage potential from second conductor 210B (hot power) and the stepping relay 130 steps from the open step into the closed step.

Note that the remote reset switch 226 is anticipated to be a momentary switch, with or without security. Note also that, even though the door interlock switches 120/122 are shown, any number of door interlock switches 120/122 are anticipated, including one door interlock switch 120/122. Two door interlock switches 120/122 are provided to prevent an intruder from defeating the lock 112 and bending the access door 110 without triggering the door interlock switches 120/122.

Figure 6:
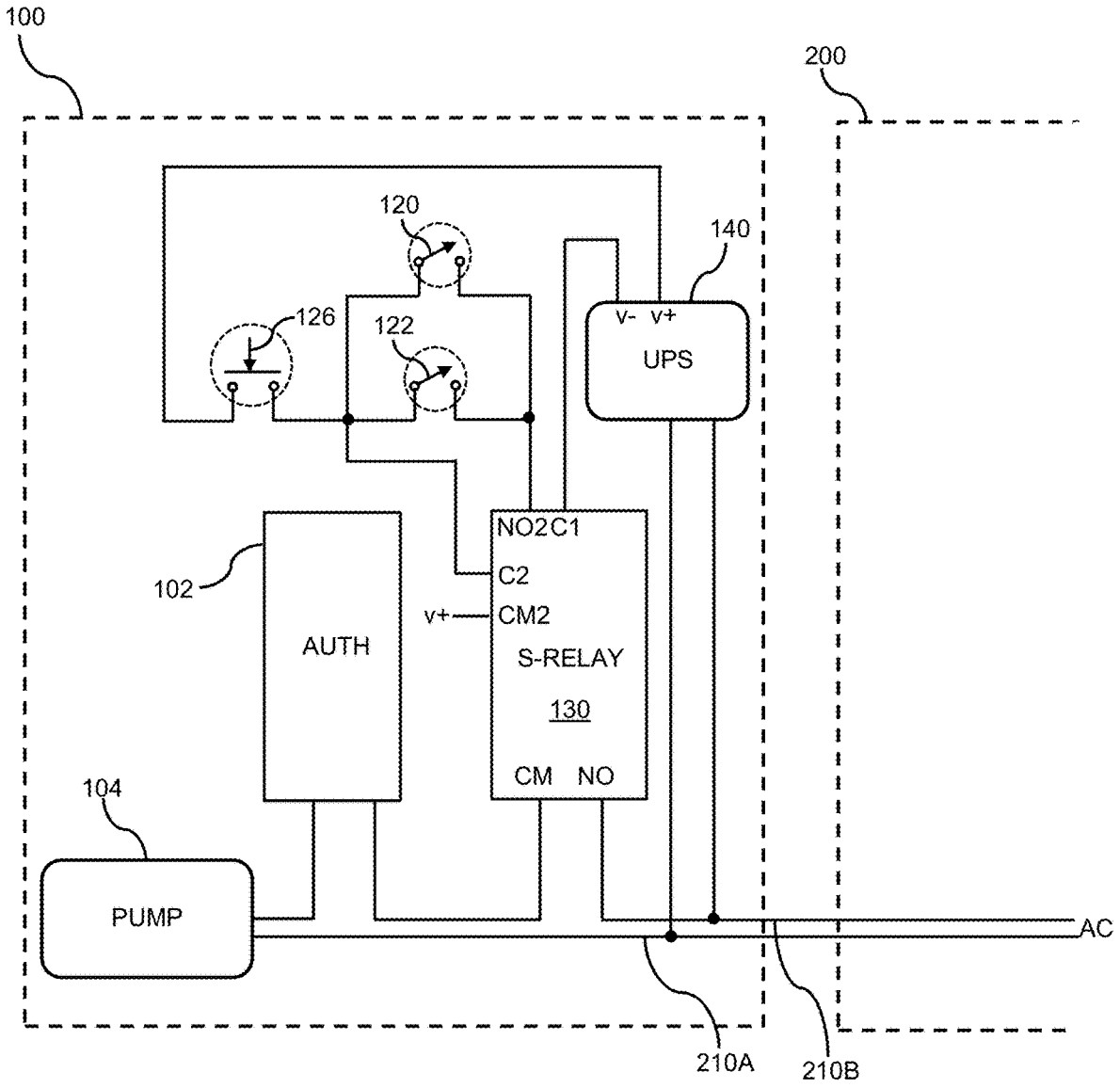
FIG. 6 illustrates a third electrical schematic view of a fuel dispenser and central closet equipped with access detection and fuel pump lock-out.

Referring to FIG. 6, a third electrical schematic view of a fuel dispenser 100 and central closet 200 equipped with access detection and fuel pump lock-out is shown. As in FIG. 4, AC power is provided by the central closet 200 through conductors 210A/210B, for example, a first conductor 210A is the neutral power and a second conductor 210B is the hot power. The first conductor 210A is connected directly to the fuel pump 104 and to an uninterruptable power supply 140. The stepping relay has connections for two coil inputs (C1 and C2) and connections for two sets of contacts, one set (CM, NO) is as in the prior examples having a common (CM) and a normally open (NO), though a normally closed contact would work as well. The second set (CM2, NO2) has a second common (CM2) and a second normally open (NO2), though a normally closed contact would work as well. In this example, low-voltage pulses between the two coil inputs (C1 and C2) "steps" the stepping relay 130 between open and closed, for example, 12 VDC pulses. In one step of the stepping relay 130, all contacts (CM-NO and CM2-NO2) are open and in the alternate step of the stepping relay 130, all contacts (CM-NO and CM2-NO2) are closed. When the contacts (CM, NO) of the stepping relay 130 are closed, power from the second conductor 210B (e.g., Hot) is provided to the authorization subsystem 102 such that, if authorization is made, power is provided to the fuel pump 104 as well, resulting in dispensing of fuel from the handle/spout 105.

There are two sets of switches interfaced between low-voltage power from the uninterruptable power supply 140 and the second coil input (C2) of the stepping relay 130. The first set of switches are the door interlock switches 120/122 that are normally open and wired in an "or" configuration such that if either of the door interlock switches 120/122 closes, the circuit between the second coil input (C2) of the stepping relay 130 and the low-voltage potential from the output (CM2) of the stepping relay 130 closes and, hence, when the stepping relay 130 is in the alternate step, the contacts (CM2, NO2) are closed and lower-voltage power is provided to one side of the door interlock switches 120/122. Now, if the access door 110 is now opened, the door interlock switches 120/122 close and the circuit between the second coil input (C2) of the stepping relay 130 and the low-voltage potential from the output (CM2) of the stepping relay 130 receives power and the stepping relay 130 steps into the open step, in which the circuit between the stepping relay 130 contacts (CM-NO and CM2-NO2) open, thereby removing power from the authorization subsystem 102 and, subsequently, removing power from the fuel pump 104 so that no fuel can be pumped. Low voltage power is also removed from the door interlock switches 120/122 and, therefore, further operation of the door interlock switches 120/122 will not provide power pulses to the coil inputs (C1 and C2) of the stepping relay 130 and, the stepping relay 130 will remain in the open step.

To reset the stepping relay 130, a reset switch 126 (or remote reset switch 226 as above) is provided. The reset switch 126 is housed within the fuel dispenser 100 and preferably is a momentary contact security switch, for example, key-operated. Operating the reset switch 126 closes the circuit between the second coil input (C2) of the stepping relay 130 and the low-voltage potential from the uninterruptable power supply 140 and the stepping relay 130 steps from the open step into the closed step.

Note that for added security, the reset switch 126 is anticipated to be a momentary switch with security. Note also that, even though the door interlock switches 120/122 are shown, any number of door interlock switches 120/122 are anticipated, including one door interlock switch 120/122. Two door interlock switches 120/122 are provided to prevent an intruder from defeating the lock 112 and bending the access door 110 without triggering the door interlock switches 120/122.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A security device for a fuel dispenser, the security device comprising:

a stepping relay having a coil input and contacts, the contacts alternately open and close after each electrical pulse received at the coil input, the contacts electrically connected in series between a source of power and an input power to a fuel pump system such that when the contacts are open, the power does not flow to the fuel pump system and no fuel is dispensed;

at least one door interlock switch that is mechanically interfaced to an access door of the fuel dispenser, the at least one door interlock switch is electrically interfaced to the input power to the fuel pump system such that when the contacts of the stepping relay are closed, opening of the access door causes at least one of the door interlock switches to close, providing power to the coil input, thereby the contacts of the stepping relay open to disconnect the power from the input power to the fuel pump system; and a reset switch is electrically interfaced between the source of the power and the coil input such that operation of the reset switch provides the power to the coil input, thereby causing the stepping relay to step such that if the contacts are open, the contacts close; and if the contacts are closed, the contacts open.

2. The security device of claim 1, wherein the door interlock switches are normally open.

3. The security device of claim 1, wherein the reset switch is a momentary contact key switch mounted within the fuel dispenser.

4. The security device of claim 1, wherein the reset switch is a momentary contact switch located external to the fuel dispenser.

5. The security device of claim 1, wherein the stepping relay has a second set of contacts, the reset switch is powered by a low-voltage, and the door interlock switches are powered by the low-voltage through the second set of contacts.

6. The security device of claim 5, wherein the low-voltage is provided by an uninterruptable power supply within the fuel dispenser.

7. A security device for a fuel dispenser, the security device comprising:

a stepping relay having a coil input, a first set of contacts and a second set of contacts, both the first set of contacts and the second set of contacts alternately open and close after each electrical pulse received at the coil input, the first set of contacts electrically connected in series between a source of electric power and a power input of a fuel pump system such that when the first set of the contacts are open, electricity does not flow to the fuel pump system and no fuel is dispensed;

an uninterruptable power supply within the fuel dispenser electrically receiving electrical power from the source of the electric power and providing a low-voltage electrical power;

at least one door interlock switch that is mechanically interfaced to an access door of the fuel dispenser, the at least one door interlock switch is electrically interfaced to the low-voltage electric power through the second set of contacts such that when the second set of contacts are closed, opening of the access door causes at least one of the door interlock switches to close, providing the low-voltage electric power to the coil input which opens both the first set of contacts and the second set of contacts, thereby disconnecting the source of the electrical power from the fuel pump system; and a reset switch electrically interfaced between the low-voltage source of the power and the coil input such that operation of the reset switch connects the low-voltage source of the power to the coil input, thereby causing the stepping relay to step such that if the first set of contacts are open, the first set of contacts close; and if the first set of contacts are closed, the first set of contacts open.

8. The security device of claim 7, wherein the door interlock switches are normally open.

9. The security device of claim 7, wherein the reset switch is a momentary contact key switch mounted within the fuel dispenser.

10. The security device of claim 7, wherein the reset switch is a momentary contact switch located external to the fuel dispenser.

11. The security device of claim 7, wherein the stepping relay has a second set of contacts, the reset switch is powered by a low-voltage, and the door interlock switches are powered by the low-voltage through the second set of contacts.

12. The security device of claim 11, wherein the low-voltage is provided by an uninterruptable power supply within the fuel dispenser.

13. The security device of claim 11, wherein the low-voltage is 12 volts direct current.

* * * * *